US005681808A

United States Patent [19]

Kobayashi et al.

[11] Patent Number: 5,681,808

[45] Date of Patent: Oct. 28, 1997

[54] DETERGENT COMPOSITIONS

[75] Inventors: Hideki Kobayashi; Hidetoshi Kondo, both of Chiba Perfecture, Japan

[73] Assignee: Dow Corning Toray Silicone Co., Ltd., Tokyo, Japan

[21] Appl. No.: 362,092

[22] Filed: Dec. 22, 1994

[30] Foreign Application Priority Data

Dec. 29, 1993 [JP] Japan ..... 5-353801

[51] Int. Cl.[6] ..... C11D 3/08; C11D 7/14

[52] U.S. Cl. ..... 510/511; 510/776; 510/512

[58] Field of Search ..... 252/176.15, 95, 252/108, 547, 174.21, 174.22, 174.23, 135; 510/276, 511, 512

[56] References Cited

U.S. PATENT DOCUMENTS 4,395,352 7/1983 Kulkarni et al. ..... 252/321

4,396,524 8/1983 Hempel et al. ..... 252/174.15

4,652,392 3/1987 Boginski et al. ..... 252/109

4,686,060 8/1987 Crabtree et al. ..... 252/96

4,732,694 3/1988 Gowland et al. ..... 252/174.21

*Primary Examiner*—Glenn A. Caldarola

*Assistant Examiner*—Alexander G. Ghyka

*Attorney, Agent, or Firm*—Timothy J. Troy

[57] ABSTRACT

The present invention relates to a detergent composition comprising at least 1 surfactant, at least 1 detergency builder, and a foam suppressor composition comprising an organosilicon compound as the base oil and silica. The detergent compositions of this invention do not require the use of a large amount of water during the rinsing stage and allow continuous suppression of foam at the rinsing stage after washing without impairing the detergency effect of the composition.

23 Claims, No Drawings

DETERGENT COMPOSITIONS

BACKGROUND OF THE INVENTION

The present invention relates to detergent compositions. More particularly, the present invention relates to detergent compositions which can continuously suppress foam at the rinsing stage after washing without impairing the detergency.

In order to remove soil on clothing, the dirty clothing is thrown into water containing a detergent composition, and the soil is dispersed in water by mechanical means such as a washing machine, and then, after the water containing the dispersed soil is drained, it is necessary to rinse the clothing several times with fresh water. However, there has been a problem in conventional detergent compositions in that foam at the rinsing stage does not disappear easily and a large amount of rinsing water is required.

Because of this situation, various studies have been made for detergent compositions which would be excellent in detergency and also could suppress foam at the rinsing stage after washing. Several detergent compositions have been proposed. For example, Japanese Patent Application Laid-Open No. 60-106508 (106,508/85) discloses a detergent composition consisting of a surfactant and a foam suppressor composition which consists of a mixture of a high viscosity dimethylpolysiloxane foam suppressor and a high shear mixture of dimethylpolysiloxane and hydrophobicized silica foam suppressor, dispersed in ethoxylated nonionic surfactant. Japanese Patent Application Laid-Open No. 62-84197 (84,197/87) discloses a detergent composition consisting of a surfactant and a foam suppressor composition which consists of diorganopolysiloxane and silica. Japanese Patent Application Laid-Open Nos. 62-230899 (230,899/87) and 62-230900 (230,900/87) disclose a detergent composition consisting of a surfactant, builder, and a foam suppressor composition which consists of fatty acid soap, quaternary ammonium salt, and diorganopolysiloxane.

However, since the detergent compositions proposed hereinabove employ dimethylpolysiloxane as a base oil for the foam suppressor component, they gradually lose defoaming characteristics under acidic or alkaline conditions and cannot continuously suppress foam at the rinsing stage after washing because they are drained with soil-dispersed water or drained with rinsing water.

SUMMARY OF THE INVENTION

Thus the present invention relates to a detergent composition comprising at least 1 surfactant, at least 1 detergency builder, and a foam suppressor composition comprising an organosilicon compound as the base oil and silica.

It is an object of the present invention to produce detergent compositions which do not require the use of a large amount of water during the rinsing stage.

It is a further object of the present invention to provide detergent compositions which allow continuous suppression of foam at the rinsing stage after washing without impairing detergency.

DETAILED DESCRIPTION OF THE INVENTION

The present invention relates to a detergent composition comprising: (A) 2–90 weight % of at least 1 surfactant, (B) 1–98 weight % of at least 1 detergency builder, and (C) 0.001–20 weight % of a foam suppressor composition comprising: (i) 100 parts of an organosilicon compound having its general formula selected from the group consisting of:

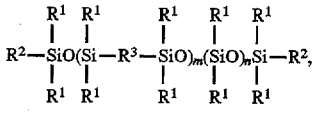

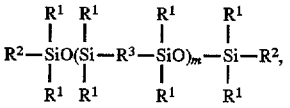

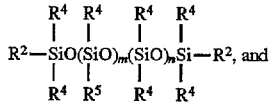

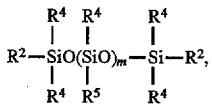

wherein $R^1$ is monovalent hydrocarbon group free of aliphatic unsaturation, $R^2$ is selected from a monovalent hydrocarbon group, hydrogen atom, or hydroxyl group, $R^3$ is an alkylene group, $R^4$ is monovalent hydrocarbon group, $R^5$ is monovalent hydrocarbon group having from 2 to 18 carbon atoms, m has a value of at least 2, n has a value of at least 1, with the proviso that $m \geqq n$, and (ii) 1–50 parts by weight of silica having a specific surface area of at least 50 $m^2/g$.

Component (A), the surfactant, can be an anionic surfactant, cationic surfactant, amphoteric surfactant, nonionic surfactant, or mixtures of two or more different types of surfactants. Anionic surfactants suitable as (A) include sodium laurate, sodium myristate, sodium palmitate, and sodium stearate. Cationic surfactants suitable as (A) include quaternary ammonium salts such as primary-tertiary aliphatic amine salts, tetraalkyl ammonium salts, trialkylbenzyl ammonium salts, alkylpyridinium salts, 2-alkyl-1-alkyl-1-hydroxyethylimidazolinium salts, N,N-dialkylmorpholinium salts, polyethylenepolyamine aliphatic amide salts, salts of urea condensates of polyethylenepolyamine aliphatic amides, and quaternary ammonium salts of urea condensates of polyethylenepolyamine aliphatic amides. Amphoteric surfactants suitable as (A) include N,N-dimethyl-N-alkyl-N-carboxymethylammonium betaines, N,N-dialkylaminoalkylene carboxylates, N,N,N-trialkyl-N-sulfoalkyleneammonium betaines, N,N-dialkyl-N,N-bispolyoxyethyleneammonium sulfate betaines, and 2-alkyl-1-carboxymethyl-1-hydroxyethylimidazolinium betaines. Nonionic surfactants suitable as (A) include polyoxyethylenealkylethers, polyoxyethylenealkylphenylethers, polyoxyethylenepolystyrylphenylether, polyoxyethylenepolyoxypropyleneglycol, polyoxyethylenepolyoxypropylenealkylethers, polyhydric alcohol fatty acid partial esters, polyoxyethylenepolyhydric alcohol fatty acid partial esters, polyoxyethylene fatty acid esters, polyglycerin fatty acid esters, polyoxyethylenized caster oil, fatty acid diethanolamide, polyoxyethylenealkylamines, triethanolamine fatty acid partial esters, and trialkylamine oxides.

In order to have the present composition exhibit excellent detergency, the amount of the component (A) in the compositions of this invention preferably ranges from 2 to 90 weight %, said weight % being based on the total weight of the detergent composition.

Component (B), the detergency builder, improves the detergency effect of (A) in the compositions of this invention, and can be, for example, a water softener which seals off the metallic ions in the washing bath, an alkali agent which keeps the washing bath alkaline and neutralizes the fatty acid component in the soil to form water soluble soap for easier washing, a neutral salt which promotes micelle formation and adsorption of the surfactant and reduces the surface tension of the washing bath or interfacial tension between the washing bath and items to be washed, or a dispersant or resoiling inhibitor which stably disperses the soil brought into the washing bath and prevents resoiling of the items to be washed. Water softeners suitable as (B) include sodium ethylenediaminetetraacetate (EDTA), sodium nitrilotriacetate (NTA), sodium citrate, or sodium tripolyphosphate. Alkali agents suitable as (B) include sodium polyphosphates such as sodium tripolyphosphate, sodium silicate, sodium carbonate, or sodium borate. Neutral salts suitable as (B) include Glauber's salt or magnesium chloride. Dispersant or resoiling inhibitors suitable as (B) include carboxymethylcellulose and other water-soluble polymers. Inorganic builders, such as zeolites, are also suitable as (B).

In order for compositions of this invention to exhibit the excellent detergency, the amount of component (B) in the compositions of this invention should range from 1 to 98 weight %, and preferably ranges from 10–98 weight %, said weight percent being based on the total weight of the detergent composition.

Component (C), the foam suppressor, is the component which suppresses foaming continuously at the rinsing stage after washing. Component (C) comprises 100 parts by weight of organosilicon compound (i) as described hereinabove is the base oil component of the foam suppressor composition (C) and (ii) 1–50 parts by weight of silica having a surface area of at least 50 $m^2/g$.

The group $R^1$ in the above formula for (i) is a monovalent hydrocarbon group free of aliphatic unsaturation including alkyl groups such as methyl, ethyl, propyl, butyl, pentyl, or hexyl, aryl groups such as phenyl, tolyl or xylyl, aralkyl groups such as benzyl or phenethyl, or a halogen substituted alkyl group such as 3-chloropropyl or 3,3,3-trifluoropropyl. The group $R^2$ above is a monovalent hydrocarbon group, hydrogen atom, or hydroxyl group. Monovalent hydrocarbon groups suitable as $R^2$ include alkyl groups such as methyl, ethyl, propyl, butyl, pentyl, or hexyl, alkenyl groups such as vinyl, allyl, butenyl, pentenyl, or hexenyl, aryl groups such as phenyl, tolyl, or xylyl, aralkyl groups such as benzyl or phenethyl, or a halogen substituted alkyl group such as 3-chloropropyl or 3,3,3-trifluoropropyl. The group $R^3$ is an alkylene group. Alkylene groups suitable as $R^3$ include methylmethylene, ethylene, methylethylene, propylene, butylene, pentylene, and hexenylene. The group $R^4$ is a monovalent hydrocarbon group. The monovalent hydrocarbon groups suitable as $R^4$ are as defined for $R^2$ hereinabove. Monovalent hydrocarbon groups having from 2 to 18 carbon atoms suitable as $R^4$ include alkyl groups such as ethyl, propyl, butyl, pentyl, hexyl, heptyl, octyl, nonyl, decyl, undecyl, and dodecyl, alkenyl groups such as vinyl, allyl, butenyl, pentenyl, hexenyl, octenyl, or nonenyl, aryl groups such as phenyl, tolyl, xylyl, and naphthyl, or aralkyl groups such as benzyl and phenethyl.

Preferably organosilicon compound (i) is a compound having its general formula selected from the group consisting of:

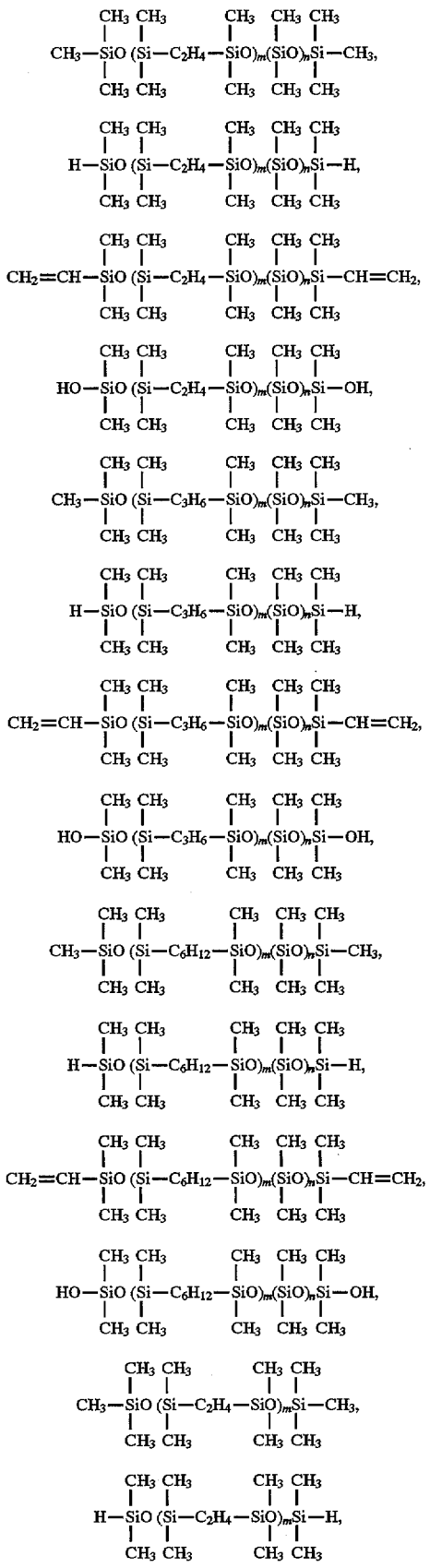

-continued

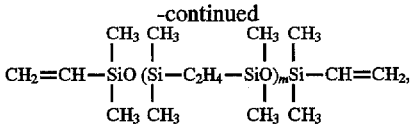

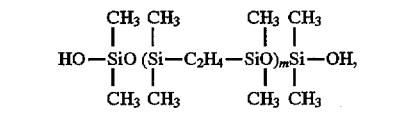

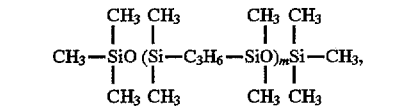

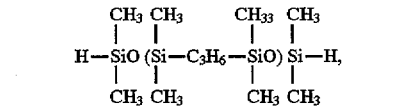

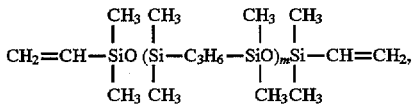

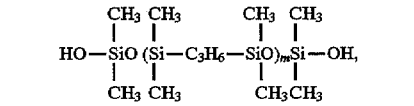

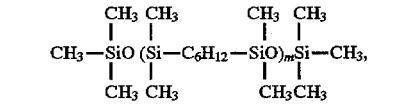

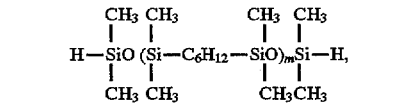

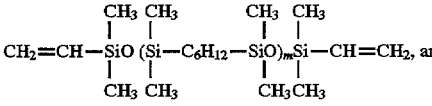

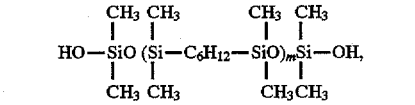

wherein m has a value of at least 2, n has a value of at least one, with the proviso that m≧n.

Methods for preparing such organosilicon compounds is not particularly limited. For example, they can be prepared by the addition polymerization of (i) a 1,3-dihydrogendisiloxane such as 1,1,3,3-tetramethyldisiloxane or 1,3-dimethyl-1,3-diphenyldisiloxane, (ii) a 1,3-dialkenyldisiloxane such as 1,1,3,3-tetramethyl-1,3-divinyldisiloxane, 1,1,3,3-tetramethyl-1,3-diallyldisiloxane, or 1,3-dimethyl-1,3-diphenyl-1,3-divinyldisiloxane in the presence of a platinum catalyst, by the addition polymerization of a polysilalkylenesiloxane having silicon-bonded hydrogen atoms at both terminals and a dimethylpolysiloxane having vinyl groups at both terminals in the presence of a platinum catalyst, by the addition polymerization of a polysilalkylenesiloxane having vinyl groups at both terminals and a dimethylpolysiloxane having silicon-bonded hydrogen atoms at both terminals in the presence of a platinum catalyst, by the condensation polymerization of a polysilalkylenesiloxane having silanol groups at both terminals and a dimethylpolysiloxane having silanol groups or silicon-bonded hydrogen atoms at both terminals in the presence of a catalyst for the condensation reaction, or by the addition polymerization of a (i) α,ω-dihydrogensiloxane oligomer such as 1,1,3,3,5,5-hexamethyltrisiloxane or 1,1,3,3,5,5,7,7-octamethyltetrasiloxane, (ii) a α,ω-dialkenylsiloxane oligomer such as 1,1,3,3-tetramethyl-1,3-divinyldisiloxane, 1,1,3,3,5,5-hexamethyl-1,5-divinyltrisiloxane, or 1,1,3,3,5,5,7,7-octamethyl-1,7-divinyltetrasiloxane in the presence of a platinum catalyst.

Organosilicon compound (i) can also be a compound having its average general formula selected from the group consisting of

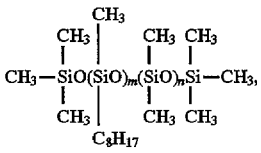

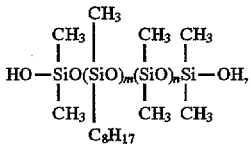

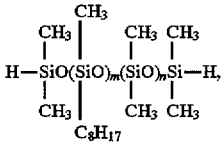

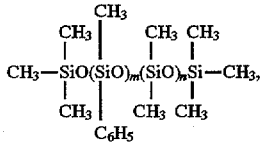

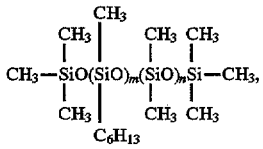

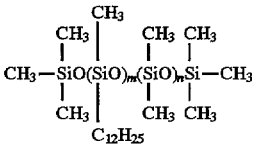

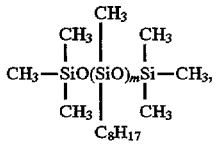

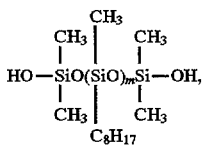

-continued

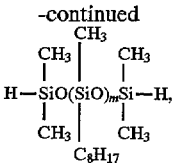

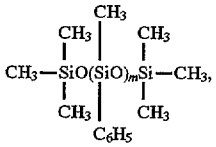

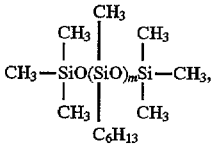

and

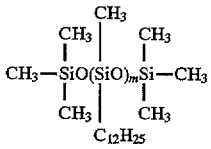

wherein m has a value of at least 2, n has a value of at least one, with the proviso that m≧n.

The viscosity of organosilicon compound (i) at 25° C. is not particularly limited, and it is preferred to be higher than 5 mPa.s (millipascal-seconds) for the sake of easier handling and better foam-suppressing characteristics, and as for the upper limit, those with a gum-like viscosity can be used.

The silica (ii) is required to have a specific surface area at least 50 $m^2/g$. If the specific surface area is less than 50 $m^2/g$, its dispersibility in organosilicon compound (i) is poor, and the foam-suppressing characteristics are inferior. Specifically, fine powder silica is preferred and can be fumed silica obtained by the dry method, burned silica, precipitated fine powder silica obtained by the wet method, silica aerogel, fine powder quartz, or fused fine powder silica. Also, these fine powder silicas can be surface-treated in advance with a silane compound or an organosiloxane oligomer, or they can be surface-treated with a silane compound or an organosiloxane oligomer at the time they are compounded with the compound (i). The silane compound which may be used for surface treatment of the silica can be specifically, an organoalkoxysilane such as methyltrimethoxysilane, or vinyltrimethoxysilane, an organosilazane such as hexamethyldisilazane, or an organohalosilane such as trimethylchlorosilane or dimethylvinylchlorosilane, or an organosiloxane oligomer such as a silanol-endblocked dimethylsiloxane oligomer, a silanol-endblocked dimethylsiloxane-methylvinylsiloxane copolymer oligomer, a silanol-endblocked dimethylsiloxane-methylphenylsiloxane copolymer oligomer, a silanol-endblocked methylvinylsiloxane oligomer, or a silanol-endblocked methylphenylsiloxane oligomer.

In component (C), the amount of silica (ii) should be in the range of 1–50 parts by weight per 100 parts by weight of organosilicon compound (i). The specific gravity at 25° C. of component (C) is preferably less than 0.97. If the specific gravity at 25° C. of component (C) is greater than 0.97, it may be drained with the soil-dispersed water, or drained with the rinsing water, and it becomes impossible to suppress foaming continuously at the rinsing stage after washing.

Component (C), the foam suppressor, can be prepared easily by uniformly mixing organosilicon compound (i) and silica (ii) described hereinabove. The foam suppressor (C), can also optionally comprise organopolysiloxanes such as a trimethylsiloxy-endblocked dimethylpolysiloxane, a trimethylsiloxy-endblocked methylvinylpolysiloxane, a trimethylsiloxy-endblocked methylphenylpolysiloxane, a trimethylsiloxy-endblocked dimethylsiloxane-methylvinylsiloxane copolymer, a trimethylsiloxy-endblocked dimethylsiloxane-methylphenylsiloxane copolymer, or a trimethylsiloxy-endblocked diphenylpolysiloxane, silicone resins such as triorganosiloxysilicate, or fine powder metal hydroxides such as aluminum hydroxide, calcium hydroxide, or magnesium hydroxide. The triorganosiloxysilicate can be expressed by the formula: $\{(CH_3)_3SiO_{1/2}\}_x\{SiO_{4/2}\}_y$ wherein x has a value ranging from 3 to 5, and y has a value ranging from 0.5 to 8. The triorganosiloxysilicate can be obtained by co-hydrolysis of tetraalkoxysilane and trimethylchlorosilane, or by co-hydrolysis of water glass and trimethylchlorosilane in a toluene/water mixture.

Component (C), the foam suppressor, can also be made solid-like by coating or by encapsulating it with a carrier material. The carrier material is not limited as to type so long as it is water-soluble or has excellent water-dispersibility, and is solid at room temperature. The carrier material can be for example, polyethylene glycols, polyethylene glycol-polypropylene glycol copolymers, higher alcohols, higher fatty acid esters, gelatin, agar-agar, or starch. By coating or encapsulating (C) with such materials, (C) can be used by pulverizing it into finely flaky, globular, or amorphous shapes.

There is no particular limitation on the equipment to prepare (C), and it should preferably be equipment which allows for simultaneous heating and stirring. Such equipment includes for example, a homomixer, ball mill, colloid mill, or three roll mill. In addition, the foam suppressing characteristics of (C) can be improved by heating foam suppressor composition (C) preferably in the range of 30° C.–200° C., and more preferably in the range of 30–150° C. The heating of (C) can occur during the mixing of organosilicon compound (i) and silica (ii), or after (i) and (ii) are mixed. Also it is preferred, during the heating of (C) to add a small amount of acidic catalyst such as sulfuric acid in order to increase the effect of the treatment. In this process, it is preferred to mix it in an inert gas atmosphere or under reduced pressure if needed.

The amount of component (C) in the detergent compositions of this invention should be in the range of 0.001–20 weight %, and preferably in the range of 0.1–15 weight %, said weight percent being based on the total weight of the detergent composition, so that the foaming at the rinsing stage after washing can be suppressed continuously without impairing the detergency of the compositions of this invention.

The detergent composition in the present invention can be prepared by uniformly mixing components (A), (B), and (C) described above. The detergent compositions of the present invention can contain optional ingredients such as fluorescent brightening agents including bis(triazinylamino) stilbenedisulfonic acid derivatives, coumarin derivatives, or pyrazoline derivatives, enzymes such as proteolytic enzyme (protease), amylolytic enzyme (amylase), fat decomposing enzyme (lipase), or cellulose decomposing enzyme (cellulase).

There is no particular limitation on the equipment used to prepare the detergent composition of this invention, and preferably it can be the equipment used to prepare component (C). There is no limitation on the form of detergent composition of the present invention as it can range from being a liquid to a solid powder.

The detergent compositions of the present invention are explained in detail in the examples hereinbelow. The viscosity in the examples was measured at 25° C.

EXAMPLE 1

To 100 parts by weight of an organosilicon compound having the formula:

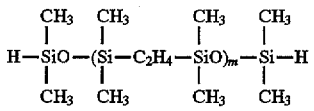

and having a viscosity of about 1,000 mPa.s, was added 7 parts by weight of precipitated silica having a specific surface area of about 300 $m^2/g$ and this mixture was stirred at room temperature for 1 hour. Next about 0.01 part by weight of sulfuric acid was added to this mixture, and this mixture was stirred at 60° C. for 2 hours, resulting in invention foam suppressor composition #1 having a specific gravity of about 0.95 at 25° C.

Next, invention detergent composition #1 was prepared by uniformly mixing 30 weight % of sodium dodecylbenzenesulfonate, 3 weight % of sodium lauryl sulfate, 3 weight percent of sodium laurylether sulfate (having 4 moles of ethyleneoxide adduce), 20 weight % of soluble sodium silicate, 10 weight % of sodium sulfate, 20 weight % of sodium aluminosilicate, 3 weight % of citric acid, 0.5 weight % of fluorescent brightening agent, 1 weight % of proteolytic enzyme (protease), 1 weight % of carboxymethylcellulose, 6.5 weight % of water, and 2 weight % of invention foam suppressor composition #1.

After 40 liters of water and 45 grams of invention detergent composition #1 was loaded and stirred in a commercially available automatic washing machine having a 50 liter capacity, 1 kg of salad oil-stained cotton bath towels were loaded into the washing machine and stirred for 15 minutes. Then, the water was drained and the towels were rinsed. About 1 minute from the start of rinsing, the rinsing water was checked and foaming was barely observed. Also, at the end of washing, the cotton bath towels were checked and it was observed that all salad oil stains were gone.

COMPARISON EXAMPLE 1

Comparison detergent composition #1 was prepared by uniformly mixing 30 weight % of sodium dodecylbenzenesulfonate, 3 weight % of sodium lauryl sulfate, 3 weight % of sodium laurylether sulfate (having 4 mole of ethyleneoxide adduct), 20 weight % of soluble sodium silicate, 10 weight % of sodium sulfate, 23 weight % of sodium aluminosilicate, 3 weight % of citric acid, 0.3 weight % of fluorescent brightening agent, 0.7 weight % of proteolytic enzyme (protease), 0.7 weight % of carboxymethylcellulose, and 6.3 weight % of water.

After 40 liters of water and 45 grams of Comparison detergent composition #1 was loaded and stirred in a commercially available automatic washing machine having a 50 liter capacity, 1 kg of salad oil-stained cotton bath towels were loaded into the washing machine and stirred for 15 minutes. Then, the water was drained and the towels were rinsed. About 1 minute from the start of rinsing, the rinsing water was checked and foaming was observed and the foam did not readily disappear. Also, at the end of washing, the cotton bath towels were checked and it was observed that all salad oil stains were gone.

COMPARISON EXAMPLE 2

Comparison foam suppressor composition #1 was prepared in the following manner: to 100 parts by weight of a trimethylsiloxy-endblocked dimethylpolysiloxane having a viscosity of about 1,000 mPa.s was added about 7 parts by weight of precipitated silica having a specific surface area of about 300 $m^2/g$, and this mixture was stirred at room temperature for about 1 hour. Next, about 0.01 part by weight of sulfuric acid was added to this mixture, and this mixture was then stirred at 60° C. for 2 hours resulting in a foam suppressor composition having a specific gravity of about 1.02 at 25° C.

Next, Comparison detergent composition #2 was prepared by uniformly mixing 30 weight % of sodium dodecylbenzenesulfonate, 3 weight % of sodium lauryl sulfate, 3 weight % of sodium laurylether sulfate (having 4 moles of ethyleneoxide adduct), 20 weight % of soluble sodium silicate, 10 weight % of sodium sulfate, 20 weight % of sodium aluminosilicate, 3 weight % of citric acid, 0.5 weight % of fluorescent brightening agent, 1 weight % of proteolytic enzyme (protease), 1 weight % of carboxymethylcellulose, 6.5 weight % of water, and 2 weight % of Comparison foam suppressor composition #1 prepared above.

EXAMPLE 2

Invention foam suppressor composition #2 was prepared in the following manner: to 100 parts by weight of a methyloctylpolysiloxane having the formula:

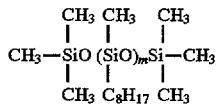

and having a viscosity of 515 mPa.s was added 7 parts by weight of precipitated silica having a specific surface area of about 300 $m^2/g$, and this mixture was stirred at room temperature for about 1 hour. Then, 0.01 parts by weight of sulfuric acid was added to this mixture, and the mixture was stirred at 60° C. for about 2 hours, resulting in a foam suppressor composition having a specific gravity of about 0.94 at 25° C. Next, about 90 parts by weight of polyethylene glycol having a melting point of about 50° C. was added to 10 parts by weight of the foam suppressor composition. This mixture was then heated and stirred. The resulting product was crushed during cooling which resulted in a powdery foam suppressor (Invention foam suppressor composition #2).

Invention detergent composition #2 was then prepared by uniformly mixing 22 weight % of sodium dodecylbenzenesulfonate, 3 weight % of sodium lauryl sulfate, 2 weight % of sodium laurylether sulfate (having 4 moles of ethyleneoxide adduct), 18 weight % of soluble sodium silicate, 13 weight % of sodium sulfate, 22 weight % of sodium aluminosilicate, 2 weight % of citric acid, 0.5 weight % of fluorescent brightening agent, 0.5 weight % of proteolytic enzyme (protease), 0.5 weight % of carboxymethylcellulose, 5.5 weight % of water, and 11 weight % of Invention foam suppressor composition #2.

After 40 liters of water and 45 grams of Invention detergent composition #2 was loaded and stirred in a commercially available automatic washing machine having a 50 liter capacity, 1 kg of salad oil-stained cotton bath towels were loaded into the washing machine and stirred for 15 minutes. Then, the water was drained and the towels were rinsed. About 1 minute from the start of rinsing, the rinsing water was checked and foaming was barely observed. Also, at the end of washing, the cotton bath towels were checked and it was observed that all salad oil stains were gone.

That which is claimed is:

1. A detergent composition comprising:

(A) 2–90 weight % of at least 1 surfactant;

(B) 1–98 weight % of at least 1 detergency builder; and (C) 0.001–20 weight % of a foam suppressor composition comprising:

(i) 100 parts by weight of a base oil comprising an organosilicon compound having its general formula selected from the group consisting of:

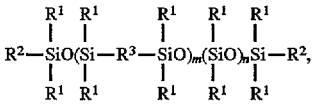

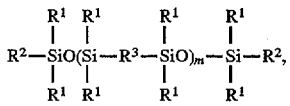

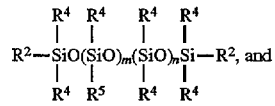

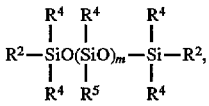

wherein $R^1$ is monovalent hydrocarbon group free of aliphatic unsaturation, $R^2$ is selected from a monovalent hydrocarbon group, hydrogen atom, or hydroxyl group, $R^3$ is an alkylene group, $R^4$ is monovalent hydrocarbon group, $R^5$ is monovalent hydrocarbon group having from 6 to 18 carbon atoms, m has a value of at least 2, n has a value of at least 1, with the proviso that $m \geqq n$; and (ii) 1–50 parts by weight of silica having a surface area of at least 50 $m^2/g$.

2. A composition according to claim 1, wherein (A) is selected from the group consisting of anionic surfactants, cationic surfactants, amphoteric surfactants, nonionic surfactants, and mixtures thereof.

3. A composition according to claim 2, wherein (A) is an anionic surfactant selected from the group consisting of sodium laurate, sodium myristate, sodium palmitate, and sodium stearate.

4. A composition according to claim 2, wherein (A) is a cationic surfactant selected from the group consisting of quaternary ammonium salts, tetraalkyl ammonium salts, trialkylbenzyl ammonium salts, alkylpyridinium salts, 2-alkyl-1-alkyl-1-hydroxyethylimidazolinium salts, N,N-dialkylmorpholinium salts, polyethylenepolyamine aliphatic amide salts, salts of urea condensates of polyethylenepolyamine aliphatic amides, and quaternary ammonium salts of urea condensates of polyethylenepolyamine aliphatic amides.

5. A composition according to claim 2, wherein (A) is an amphoteric surfactant selected from the group consisting of N,N-dimethyl-N-alkyl-N-carboxymethylammonium betaines, N,N-dialkylaminoalkylene carboxylates, N,N,N-trialkyl-N-sulfoalkyleneammonium betaines, N,N-dialkyl-N,N-bispolyoxyethyleneammonium sulfate betaines, and 2-alkyl-1-carboxymethyl-1-hydroxyethylimidazolinium betaines.

6. A composition according to claim 2, wherein (A) is a nonionic surfactant selected from the group consisting of polyoxyethylenealkylethers, polyoxyethylenealkylphenylethers, polyoxyethylenepolystyrylphenylether, polyoxyethylenepolyoxypropyleneglycol, polyoxyethylenepolyoxypropylenealkylethers, polyhydric alcohol fatty acid partial esters, polyoxyethylenepolyhydric alcohol fatty acid partial esters, polyoxyethylene fatty acid esters, polyglycerin fatty acid esters, polyoxyethylenized caster oil, fatty acid diethanolamide, polyoxyethylenealkylamines, triethanolamine fatty acid partial esters, and trialkylamine oxides.

7. A composition according to claim 1, wherein (B) is selected from the group consisting of sodium ethylenediaminetetraacetate, sodium nitrilotriacetate, sodium citrate, sodium polyphosphates, sodium silicate, sodium carbonate, sodium borate, Glauber's salt, magnesium chloride, carboxymethylcellulose, and zeolites.

8. A composition according to claim 1, wherein (i) is a compound having its formula selected from the group consisting of:

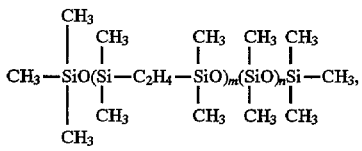

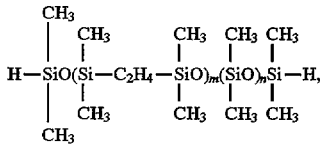

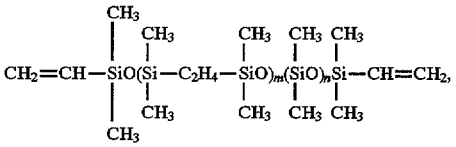

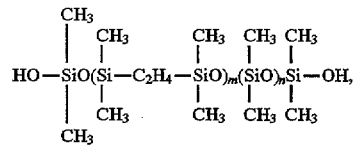

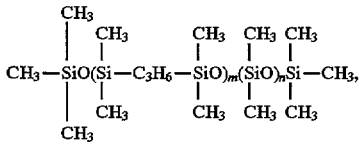

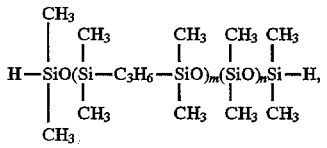

-continued
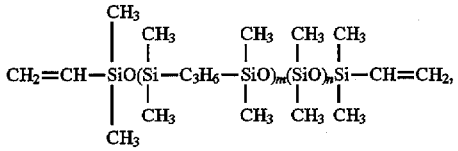
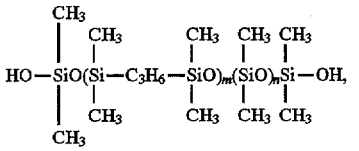
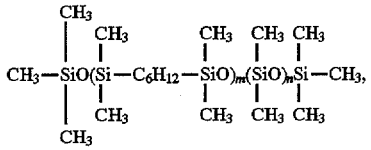
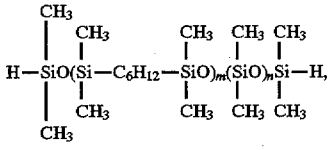
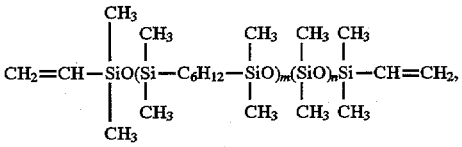
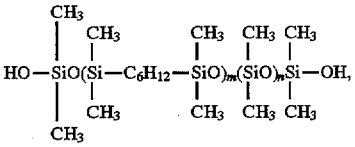
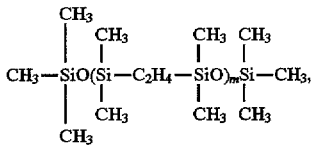
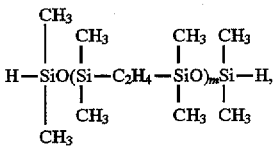
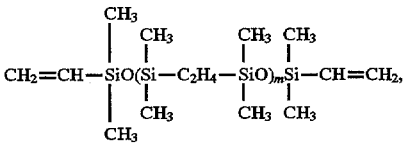
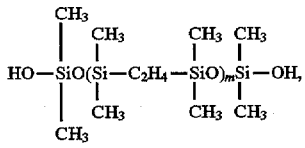
-continued
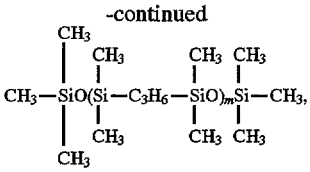
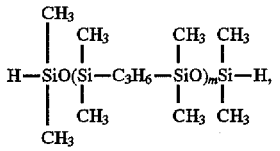
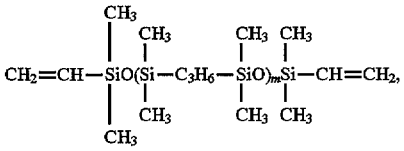
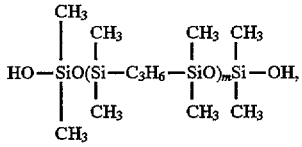
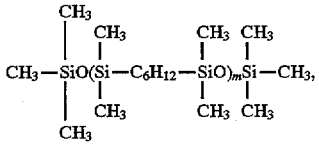
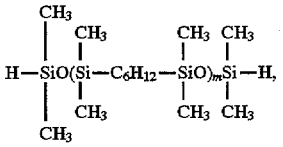
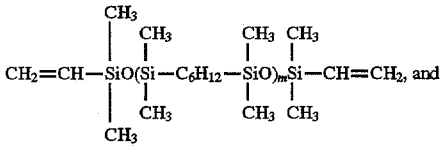
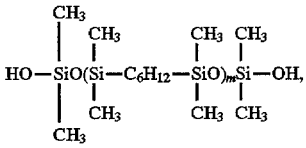
wherein m has a value of at least 2, n has a value of at least one, with the proviso that m≧n.
9. A composition according to claim 1, wherein (i) is a compound having its formula selected from the group consisting of:
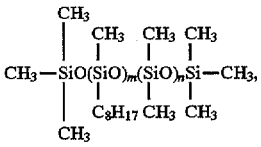

-continued

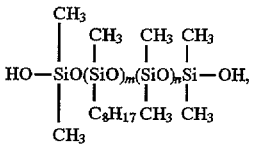

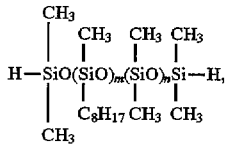

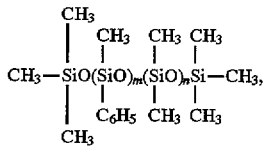

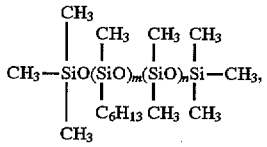

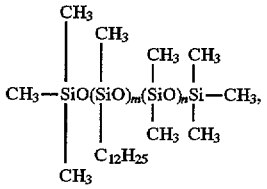

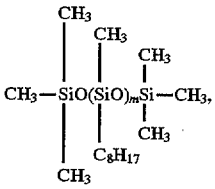

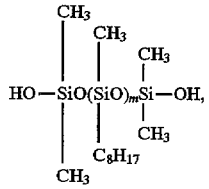

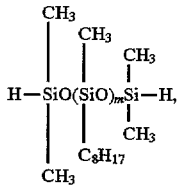

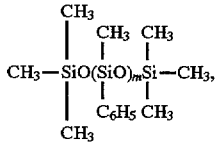

-continued

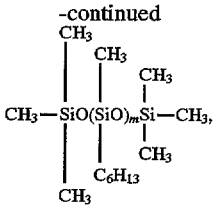

and

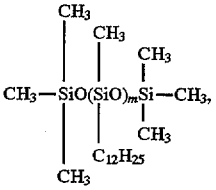

wherein m has a value of at least 2, n has a value of at least one, with the proviso that m≧n.

10. A composition according to claim 1, where (C) further comprises a compound selected from the group consisting of organoalkoxysilanes, organosilazanes, organohalosilanes, and organosiloxane oligomers.

11. A composition according to claim 10, wherein the organoalkoxysilane is selected from methyltrimethoxysilane or vinyltrimethoxysilane.

12. A composition according to claim 10, wherein the organosilazane is hexamethyldisilazane.

13. A composition according to claim 10, wherein the organohalosilane is selected from trimethylchlorosilane or dimethylvinylchlorosilane.

14. A composition according to claim 10, wherein the organosiloxane oligomer is selected from the group consisting of a silanol-endblocked dimethylsiloxane oligomer, a silanol-endblocked dimethylsiloxane-methylvinylsiloxane copolymer oligomer, a silanol-endblocked dimethylsiloxane-methylphenylsiloxane copolymer oligomer, a silanol-endblocked methylvinylsiloxane oligomer, and a silanol-endblocked methylphenylsiloxane oligomer.

15. A composition according to claim 1, wherein (C) further comprises an organopolysiloxane selected from the group consisting of a trimethylsiloxy-endblocked dimethylpolysiloxane, a trimethylsiloxy-endblocked methylvinylpolysiloxane, a trimethylsiloxy-endblocked methylphenylpolysiloxane, a trimethylsiloxy-endblocked dimethylsiloxane-methylvinylsiloxane copolymer, a trimethylsiloxy-endblocked dimethylsiloxane-methylphenylsiloxane copolymer, and a trimethylsiloxy-endblocked diphenylpolysiloxane.

16. A composition according to claim 1, wherein (C) further comprises a silicone resin.

17. A composition according to claim 16, wherein the silicone resin is a triorganosiloxysilicate having the formula: $\{(CH_3)_3SiO_{1/2}\}_x\{SiO_{4/2}\}_y$ wherein x has a value ranging from 3 to 5, and y has a value ranging from 0.5 to 8.

18. A composition according to claim 1, wherein (C) further comprises a metal hydroxide.

19. A composition according to claim 18, wherein the metal hydroxide is selected from the group consisting of aluminum hydroxide, calcium hydroxide, and magnesium hydroxide.

20. A composition according to claim 1, wherein (C) further comprises a compound selected from the group consisting of polyethylene glycols, polyethylene glycol-polypropylene glycol copolymers, higher alcohols, higher fatty acid esters, gelatin, agar-agar, and starch.

21. A composition according to claim 1, wherein the detergent composition further comprises an ingredient selected from the group consisting a fluorescent brightening agent selected from bis(triazinylamino) stilbenedisulfonic acid derivatives, coumarin derivatives, or pyrazoline derivatives, an enzyme selected from proteolytic enzyme, amylolytic enzyme, fat decomposing enzyme, or cellulose decomposing enzyme.

22. A process of controlling foam, which includes the addition of a detergent composition to a medium, the improvement comprising using as the detergent composition, the composition of claim 1.

23. A process of controlling foam, which includes the addition of a detergent composition to a medium, the improvement comprising using as the detergent composition, the composition of claim 21.

* * * * *